US006254424B1

(12) United States Patent
Murakami et al.

(10) Patent No.: US 6,254,424 B1
(45) Date of Patent: Jul. 3, 2001

(54) HALF-FITTING DETECTION CONNECTOR

(75) Inventors: Takao Murakami; Masaru Fukuda, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/598,514

(22) Filed: Jun. 21, 2000

(30) Foreign Application Priority Data

May 28, 1999 (JP) ..... 11-182037

(51) Int. Cl.[7] ..... H01R 3/00
(52) U.S. Cl. ..... 439/489; 439/352
(58) Field of Search ..... 439/488, 489, 439/345, 350, 352, 353–357

(56) References Cited

U.S. PATENT DOCUMENTS 5,183,410 * 2/1993 Inaba et al. ..... 439/489
5,670,884 * 9/1997 Kodama ..... 439/489
6,036,515 * 3/2000 Nakamura ..... 439/489
6,102,732 * 8/2000 Seko et al. ..... 439/489

FOREIGN PATENT DOCUMENTS 7-142122 6/1995 (JP) .

* cited by examiner

*Primary Examiner*—Hien Vu
(74) *Attorney, Agent, or Firm*—Sughrue, Mion, Zinn, Macpeak & Seas, PLLC

(57) ABSTRACT

A half-fitting detection connector (30) includes a lock arm (53) which is formed on an outer surface of a housing (43) of a male connector (33), and locks the two connectors to each other in a fitted condition when a retaining projection (54) is engaged in an engagement hole (58) formed in the female connector (34). A shutter (55) is formed at a distal end of the lock arm (53). The shutter (55) closes a fitting port (45*a*) for the female connection-detection terminal (48) in the male connector (33) when the retaining projection (54) is urged by a housing inner surface (64). The shutter (55) opens the fitting port (45*a*) when the retaining projection (54) is engaged in the engagement hole (58). A male connection-detection terminal (62) is received in the female connector (34), and has a spring portion (62*b*) which can be compressively deformed along the terminal fitting direction.

10 Claims, 5 Drawing Sheets

HALF-FITTING DETECTION CONNECTOR

BACKGROUND OF THE INVENTION

1. Field of the Invention

The present invention relates to a half-fitting detection connector in which a half-fitted condition of two connectors can be detected. More particularly, the present invention relates to a half-fitting detection connector provided with a connection detection device which detects a half-fitted condition of the two connectors by detecting an electrical connection between connection detection contacts retained respectively in predetermined positions in the two connectors.

The present application is based on Japanese Patent Application No. Hei. 11-182037, which is incorporated herein by reference.

2. Description of the Related Art

Usually, various electronic equipments are mounted on a vehicle such as an automobile, and therefore, naturally, various types of female and male connectors are provided at connection ends of various kinds of wires forming wire harnesses or the like.

FIGS. 6 to 8 show a conventional half-fitting detection connector provided with a connection detection device for checking whether or not male and female connectors are completely fitted together.

This half-fitting detection connector 1 is disclosed in Unexamined Japanese Patent Publication No. Hei. 7-142122. When the amount of fitting of the pair of male and female connectors 3 and 4 relative to each other reaches a predetermined value, a lock projection 8 on an elastic lock arm 7, formed on a housing 13 of the male connector 3, is engaged in a retaining hole 11 in a housing 14 of the female connector 4, so that the pair of housings 13 and 14 are locked together in a connected condition, and also connection detection contacts (contact elements) 16 and 17, held respectively in predetermined corresponding positions in the male and female connectors 3 and 4, contact each other simultaneously when the engagement of the lock arm 7 is completed.

The male and female connectors 3 and 4 are multi-pole connectors each having a plurality of connection terminals received and retained therein at predetermined intervals. One of the plurality of connection terminals, retained in the housing 13, serves as the connection detection contact 16 whereas one of the plurality of connection terminals, retained in the housing 14, serves as the connection detection contact 17.

A resilient contact piece portion 16*a* of the connection detection contact 16 in the male connector 3 is connected at one end to the lock arm 7, and this contact piece portion 16*a* is displaced in accordance with the flexing (elastic deformation) of the lock arm 7.

When the fitting operation further proceeds from an initially-fitted condition (shown in FIG. 6) of the pair of male and female connectors 3 and 4, the lock arm 7 on the male connector 3 is flexed (elastically deformed) toward the housing 13 as shown in FIG. 7 until the amount of fitting of the two connectors relative to each other reaches a predetermined amount. In the flexed condition of the lock arm 7 during the fitting operation, the connection detection contacts 16 and 17 are kept out of contact with each other as shown in the drawings.

Then, when the amount of fitting of the male and female connectors 3 and 4 reaches the predetermined amount, the lock projection 8 on the lock arm 7 is fitted in the retaining hole 11 in the female connector 4 as shown in FIG. 8, so that the flexing of the lock arm 7 is canceled, and also the withdrawal of the lock arm 7 is prevented by the engagement of the lock projection 8 in the retaining hole 11. As a result, the housings 13 and 14 of the male and female connectors 3 and 4 are locked to each other in a mutually-fitted condition.

When the lock projection 8 on the lock arm 7 is thus engaged in the retaining hole 11 in the female connector 4, the flexing of the lock arm 7 is canceled, so that the connection detection contact 16 in the male connector 3 contacts the connection detection contact 17 in the female connector 4, and this electrical connection is detected by a detection electric circuit (not shown).

In the half-fitting detection connector 1 provided with the above connection detection device, all of the connection detection terminal 17 and the connection terminals 18 and 19, provided at the female connector 4, are plate-like tab terminals.

The normal connection terminals 20, provided at the male connector 3, are socket contacts, each having a socket portion 20*a* for fitting on the associated tab terminal when the two connectors are fitted together, whereas the connection detection contact 16 has the leaf spring-like, resilient contact piece portion 16*a* which is displaced in a direction of the thickness thereof in accordance with the flexing of the lock arm 7, and is pressed against the surface of the connection detection contact 17.

Therefore, for example, when a foreign matter 22 is deposited on the surface of the plate-like connection terminal 17, this foreign matter 22 is held between the resilient contact piece portion 16*a* of the connection detection contact 16 and the terminal 17, as shown in FIG. 9. Even when the fitting connection between the male and female connectors 3 and 4 is properly completed in this condition, the connection detection contacts 16 and 17 fail to be electrically connected together. Accordingly, since the detection electric circuit detects a non-electrically-connected condition, there is a possibility of erroneously judging the two connectors to be in a half-fitted condition.

Namely, in the above half-fitting detection connector 1, there is a possibility that the reliability of the connection detection device, comprising the connection detection contacts 16 and 17, is lowered, for example, by the intrusion of a foreign matter.

SUMMARY OF THE INVENTION

It is therefore an object of the present invention to overcome the above problems, and more specifically to provide a half-fitting detection connector provided with a good connection detection device in which connection detection contacts, mounted respectively in predetermined positions, will not fail to properly contact each other because of the intrusion of a foreign matter, and a fitted condition of two connectors can be accurately detected.

To achieve the above object, according to the first aspect of the present invention, there is provided a half-fitting detection connector which comprises a first connector housing including a fitting port formed therein, a first connection-detection terminal receivable in the first connector housing, a second connector housing fittable to the first connector housing, the second connector housing including an engagement portion, a second connection-detection terminal receivable in the second connector housing, and fittable to the first connection-detection terminal, the second connection-detection terminal including a spring portion which can be compressively deformed along a terminal fitting direction, a lock arm formed on the first connector housing, and substantially extending in a fitting direction of the first and second connector housings, the lock arm including a retaining projection, the lock arm retaining the first and second connector housings in a fitted condition when the retaining projection is engaged with the engagement portion of the second connector housing, and a screen plate formed on a distal end of the lock arm, the screen plate closing the fitting port of the first connector housing when the retaining projection is urged by the second connector housing, and opening the fitting port to allow the first connection-detection terminal to fit to the second connection-detection terminal through the fitting port when the retaining projection is engaged with the engagement portion.

According to the second aspect of the present invention, the half-fitting detection connector further comprises a third connection terminal receivable in the first connector housing, and a fourth connection terminal receivable in the second connector housing, and fittable to the third connection terminal, wherein a complete fitting between the third and fourth connection terminals is prevented when a fitting between the first and the second connection-detection terminals through the fitting port is obstructed by the screen plate.

According to the third aspect of the present invention, it is preferable that a half-fitted condition of the first and second connector housings is detected by a condition of electrical connection between the first connection-detection terminal and the second connection-detection terminal.

According to the fourth aspect of the present invention, it is preferable that the spring portion is formed integrally with the second connection-detection terminal.

According to the fifth aspect of the present invention, it is preferable that the second connection-detection terminal includes a contact portion for connecting with the first connection-detection terminal, and a wire clamping portion for clamping a wire, and wherein the spring portion is formed between the contact portion and the wire clamping portion.

According to the sixth aspect of the present invention, it is preferable that the lock arm is formed in a cantilever-like manner on an outer surface of the first connector housing to extend obliquely upwardly from the outer surface of the first connector housing in a natural condition in which no external force acts on the lock arm, so that the screen plate opens the fitting port of the first connector housing.

According to the seventh aspect of the present invention, it is preferable that, when the first and second connector housings are in a half-fitted condition, the retaining projection of the lock arm abuts against an inner surface of the second connector housing so that the lock arm is downwardly urged toward the outer surface of the first connector housing thereby closing the fitting port with the screen plate, and the second connection-detection terminal is abutted against the screen plate, and when the first and second connector housings are in a completely-fitted condition, the retaining projection is engaged with the engagement portion formed in the inner surface of the second connector housing so that the screen plate opens the fitting port to allow the first connection-detection terminal to fit to the second connection-detection terminal through the fitting port.

According to the eighth aspect of the present invention, it is preferable that, when the first and second connector housings are in a half-fitted condition, the spring portion of the second connection-detection terminal is compressively deformed along the terminal fitting direction, and the first and second connector housings are pushed back away from each other by a resilient force of the spring portion.

In the above construction, during the connector fitting operation, the retaining projection of the lock arm is not engaged in the engagement portion of the second connector housing, and is urged by the inner surface of the second connector housing, and therefore the fitting port is closed by the screen plate formed on the distal end of the lock arm.

Therefore, even when the connector fitting operation proceeds, the second connection-detection terminal, received in the second connector housing, can not enter the fitting port in the first connector housing, so that the spring portion is compressively deformed along the terminal fitting direction, with its distal end held against the screen plate. Therefore, the first connection-detection terminal and the second connection-detection terminal, received and held in their respective connector housings, are positively kept out of contact with each other.

Therefore, when the fitting operation of the half-fitting detection connector is stopped in this condition, a detection electric circuit detects a non-electrically-connected condition of the first and second connection-detection terminals, and therefore a half-fitted condition of the two connector housings can be positively detected.

On the other hand, when the fitting connection between the two connector housings further proceeds, so that the two connector housings are completely fitted together, the retaining projection is engaged with the engagement portion, and hence ceases to be urged by the housing inner surface, so that the screen plate, which has so far closed the fitting port in the first connector housing in the connector fitting operation, opens this fitting port.

Therefore, the distal end portion of the second connection-detection terminal, received in the second connector housing, projects through the fitting port in the first connector housing by the resilient force of the spring portion, so that the second connection-detection terminal is positively fittingly connected to the first connection-detection terminal received in the first connector housing. Therefore, this electrical connection between the first and second connection-detection terminals is detected, thus positively detecting the completely-fitted condition of the two connector housings.

The contact of the first and second connection-detection terminals with each other is achieved by the fitting operation effected along the connector fitting direction, and therefore even if a foreign matter is deposited on the surface of the first and second connection-detection terminals, this foreign matter is removed from the surface as a result of sliding movement between the first and second connection-detection terminals, and therefore the foreign matter will not be held between the two connection-detection terminals.

Therefore, when the two connector housings are completely fitted together, the first connection-detection terminal and the second connection-detection terminal will not fail to properly contact with each other because of the intrusion of a foreign matter, and the fitted condition of the two connector housings can be accurately detected, and therefore the reliability of detection of a half-fitted condition can be enhanced.

DETAILED DESCRIPTION OF THE PREFERRED EMBODIMENTS

One preferred embodiment of a half-fitting detection connector of the present invention will now be described in detail with reference to the accompanying drawings.

Figure 1:
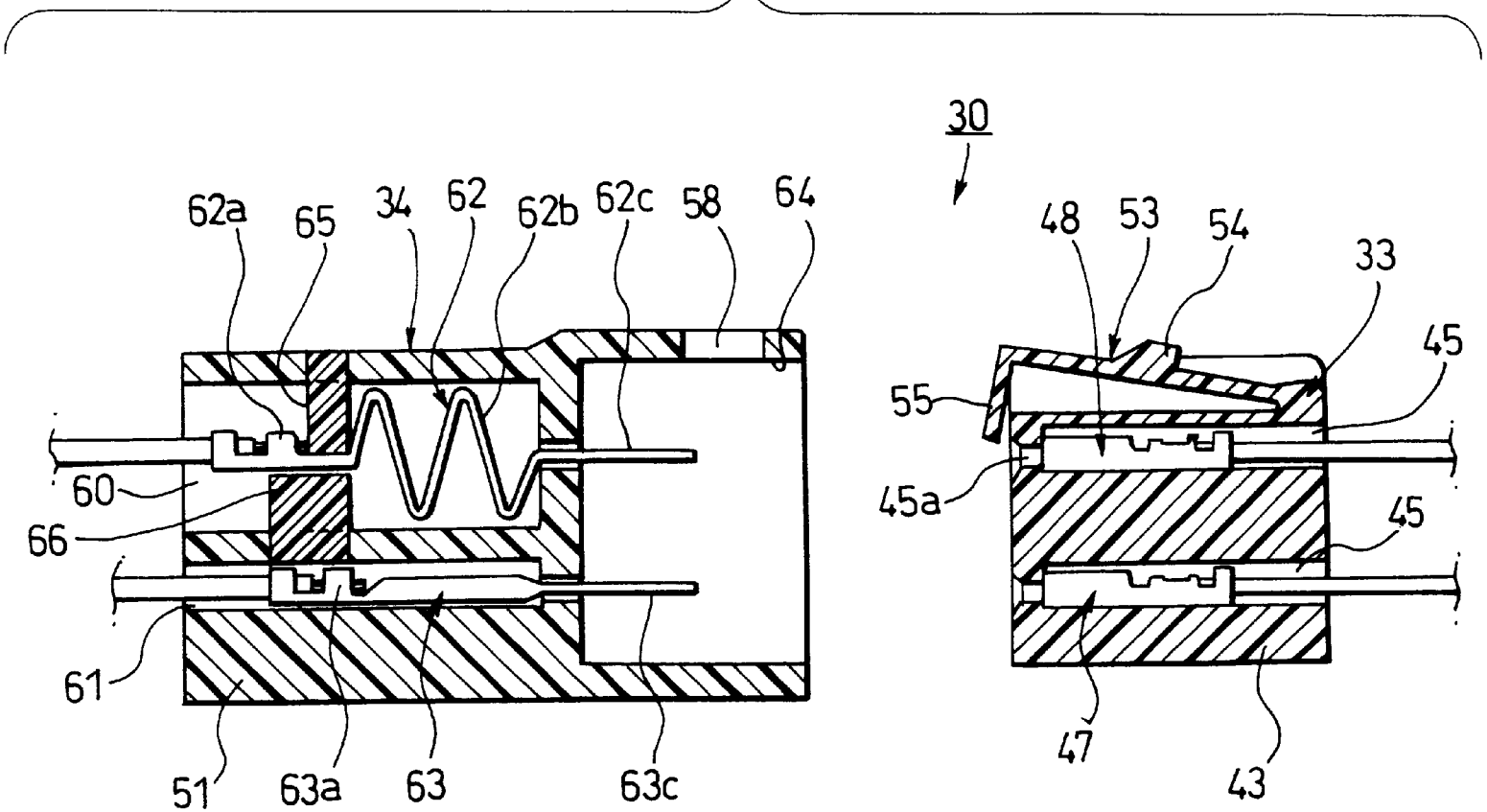
FIG. 1 is an exploded, vertical cross sectional view roughly showing one preferred embodiment of a half-fitting detection connector of the present invention.
Figure 2:
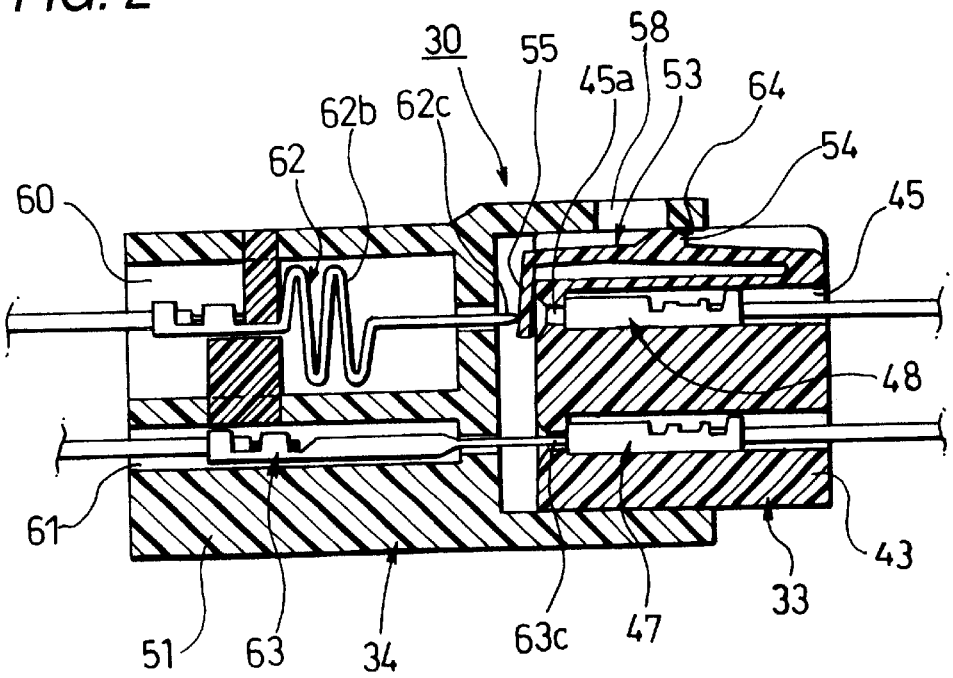
FIG. 2 is a vertical cross-sectional view of the half-fitting detection connector of FIG. 1 in a half-fitted condition.
Figure 3:
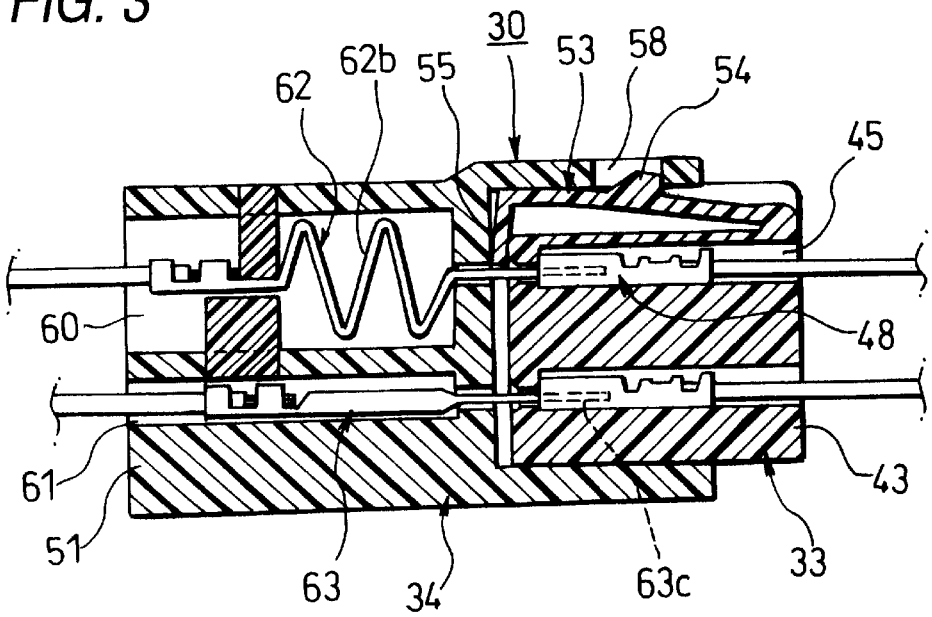
FIG. 3 is a vertical cross-sectional view of the half-fitting detection connector of FIG. 1 in a completely-fitted condition.

FIG. 1 is an exploded, vertical cross sectional view roughly showing one preferred embodiment of the half-fitting detection connector of the present invention, FIG. 2 is a vertical cross-sectional view of the half-fitting detection connector of FIG. 1 in a half-fitted condition, and FIG. 3 is a vertical cross-sectional view of the half-fitting detection connector of FIG. 1 in a completely-fitted condition.

The half-fitting detection connector 30 of this embodiment is a multi-pole connector comprising a pair of male and female connectors 33 and 34 to be fitted together in a male-female manner.

Plural rows of juxtaposed terminal receiving chambers 45 are formed in a housing 43 of the male connector (first connector) 33, and extend therethrough in a direction of fitting of the two connectors, and female terminals 47 are received and held respectively in the associated terminal receiving chambers 45.

As shown in FIG. 1, a female connection-detection terminal 48, identical in construction to the female terminal 47, is received and held in one of the terminal receiving chambers 45. This female connection-detection terminal 48 cooperates with a male connection-detection terminal 62 (described later) to provide a connection detection device for detecting a half-fitted condition of the two connectors.

Each of the female terminals 47, as well as the female connection-detection terminal 48, is retained in the associated terminal receiving chamber 45 against withdrawal by a retaining lance (not shown) or the like.

A lock arm 53 is formed (molded) integrally on an outer surface (upper surface in FIG. 1) of the housing 43, and extends in the direction of fitting of the male connector into the female connector (second connector) 34. The lock arm 53 is an elastic arm of the cantilever type extending from a rear end portion of the housing 43 toward a front end thereof. A retaining projection 54, formed on an upper surface of this lock arm, is engaged in an engagement hole 58 in the female connector 34 (described later), thereby locking the two connectors to each other in a fitted condition.

A shutter 55 in the form of a screen plate is formed integrally at a distal end of the lock arm 53. When the lock arm 53 is in a natural condition in which no external force acts on the lock arm, the lock arm 53 extends obliquely upwardly in such a manner that the shutter 55, extending downwardly from the distal end of the lock arm 53, opens a fitting port 45*a* at a front end of the terminal receiving chamber 45 receiving the female connection-detection terminal 48, as shown in FIG. 1

When the lock arm 53 is urged or pressed toward the terminal receiving chambers 45 to be disposed generally parallel to the upper surface of the housing 43, the shutter 55 closes the fitting port 45*a* at the front end of the terminal receiving chamber 45 receiving the female connection-detection terminal 48.

Although the shutter 55 is formed (molded) integrally at the distal end of the lock arm 53, the shutter may be molded into a separate member, in which case this separate member is connected to the lock arm to provide a unitary construction.

Another alternative is to provide an integrally-molded structure in which the proximal end portion of the lock arm 53 is formed into a thin hinge portion, and the lock arm 53 extends perpendicularly from the upper surface of the housing 43, and in use, the lock arm 53 thus molded is tilted toward the front end portion of the housing 43.

Terminal receiving chambers 60 and 61 are formed longitudinally through a housing 51 of the female connector 34, and are arranged in corresponding relation to the terminal receiving chambers 45 in the male connector 33.

Male terminals 63 to be received in the second connector are received and held respectively in the terminal receiving chambers 61 corresponding respectively to the terminal receiving chambers 45 receiving the female terminals 47, respectively. The male connection-detection terminal 62 to be received in the second connector is received and held in the terminal receiving chamber 60 corresponding to the terminal receiving chamber 45 receiving the female connection-detection terminal 48.

The engagement hole 58 is formed in a connector fitting portion of the housing 51 defined by a front portion thereof, and when the male connector 33 is completely fitted in the female connector 34, the retaining projection 54 is fitted in the engagement hole 58, thereby locking the two connectors to each other in this completely-fitted condition. This engagement portion is not limited to the engagement hole 58, but may be a step portion or the like recessed in the inner surface of the connector fitting portion.

The male connection-detection terminal 62 of an integral construction includes a wire clamping portion 62*a* for clamping connection to an end portion of a wire, a spring portion 62*b* formed into a wavy shape, and a tongue-like portion 62*c* for fitting into the female connection-detection terminal 48.

The spring portion 62*b* can be compressively deformed along a terminal fitting direction. The male connection-detection terminal 62 is fixed to the housing 51 at that portion thereof disposed adjacent to the wire clamping portion 62*a*, and the wavy spring portion 62*b* is resiliently deformed in the direction of compression thereof in accordance with the amount of a pressing force applied to the tongue-like portion 62*c* defining the distal end portion of this male terminal.

The male connection-detection terminal 62 is inserted into the terminal receiving chamber 60, and thereafter terminal holders 65 and 66 are inserted into the housing 51 to hold the male connection-detection terminal 62 therebetween to thereby retain the same in a predetermined position in the terminal receiving chamber 60.

The male terminals 63, corresponding respectively to the female terminals 47 received in the male connector 33, are of the ordinary type, and each of these male terminals 63 has an integral construction, and includes a wire clamping portion 63*a* for clamping connection to an end portion of a wire, and a tongue-like portion 63*c* for fitting into the female terminal 47.

When the operation for fitting the male and female connectors 33 and 34 together is started as shown in FIG. 2, the retaining projection 54, formed on the lock arm 53 of the male connector 33, abuts against an inner surface 64 of the housing 51, lying between the engagement hole 58 in the housing 51 and the front end of the housing 51, so that the lock arm 53 is urged or pressed toward the terminal receiving chambers 45 to be disposed generally parallel to the upper surface of the housing 43.

Thus, the male connector 33 is inserted into the connector fitting portion of the female connector 34, with the shutter 55 closing the fitting port 45*a* of the terminal receiving chamber 45 receiving the female connection-detection terminal 48.

Therefore, even when the connector-fitting operation thus proceeds, the male connection-detection terminal 62, received in the female connector 34, can not enter the fitting port 45*a* of the terminal receiving chamber 45, receiving the female connection-detection terminal 48, so that the spring portion 62*b* is compressively deformed along the terminal fitting direction, with the tongue-like portion 62*c* held against the shutter 55. Therefore, the female connection-detection terminal 48 and the male connection-detection terminal 62, received and held respectively in the male and female connectors 33 and 34, are positively kept out of contact with each other.

Therefore, when the fitting operation of the half-fitting detection connector 30 is stopped in this condition, a detection electric circuit (not shown) detects a non-electrically-connected condition of the female and male connection-detection terminals 48 and 62, and therefore a half-fitted condition of the two connectors can be positively detected.

On the other hand, when the fitting connection between the male and female connectors 33 and 34 further proceeds, so that the two connectors are completely fitted together as shown in FIG. 3, the retaining projection 54 is fitted in the engagement hole 58, and hence ceases to be urged by the housing inner surface 64, and the lock arm 53 is resiliently restored upwardly, so that the shutter 55, which has so far closed the fitting port 45*a* in the connector fitting operation, opens this port 45*a*.

As soon as the fitting port 45*a* is thus opened, the tongue-like portion 62*c* of the male connection-detection terminal 62, received in the female connector 34, projects through the fitting vport 45*a* by the resilient force of the spring portion 62*b*, so that the female and male connection-detection terminals 48 and 62, received respectively in the male and female connectors 33 and 34, are fitted together. As a result, the detection electric circuit (not shown) detects this electrical connection between the female and male connection-detection terminals 48 and 62, thus positively detecting the completely-fitted condition of the two connectors.

And besides, the contact of the female and male connection-detection terminals 48 and 62 with each other is achieved by the fitting operation effected along the connector fitting direction, and therefore even if a foreign matter is deposited on the surface of the female connection-detection terminal 48 or the surface of the male connection-detection terminal 62, this foreign matter is removed from the surface as a result of sliding movement between the two terminals 48 and 62, and therefore the foreign matter will not be held between the two terminals 48 and 62.

Therefore, in the half-fitting detection connector 30 of this embodiment, when the male and female connectors 33 and 34 are completely fitted together, the female connection-detection terminal 48 and the male connection-detection terminal 62 will not fail to properly contact with each other because of the intrusion of a foreign matter, and the fitted condition of the two connectors can be accurately detected, and therefore the reliability of detection of a half-fitted condition can be enhanced.

In the half-fitting detection connector of the present invention, the housings, the lock arm, the screen plate, the spring portion and so on are not limited to their respective structures in the half-fitting detection connector 30 of this embodiment, but can be modified in various ways without departing from the scope of the present invention.

Figure 4A:
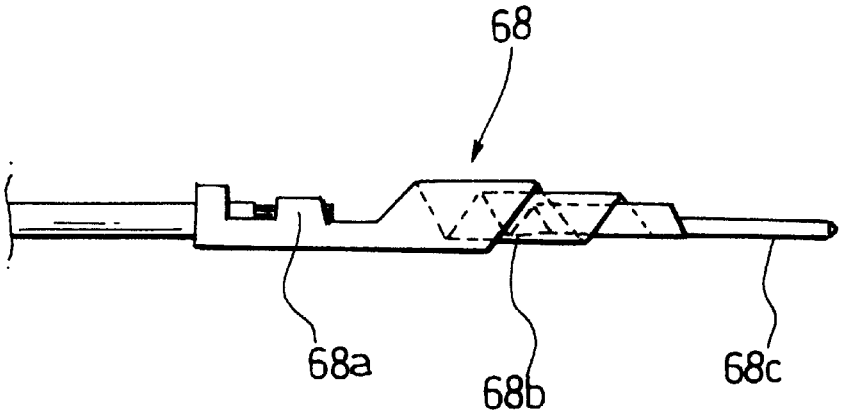
FIG. 4A is a side-elevational view of a modification of a male terminal shown in FIG. 1.
Figure 4B:
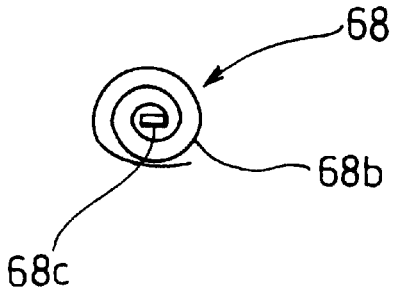
FIG. 4B is a front-elevational view thereof.

For example, a male connection-detection terminal 68, shown in FIGS. 4A and 4B, is a male connection-detection terminal to be received in the second connector, and this male connection-detection terminal of an integral construction includes a wire clamping portion 68*a* for clamping connection to the end portion of the wire, a spring portion 68*b*, and a tongue-like portion 68*c* for fitting into the female connection-detection terminal 48.

The spring portion 68*b* is in the form of a volute spring (a conical coil spring having a rectangular cross-section) which can be compressively deformed along the terminal fitting direction. The spring portion 68*b* is resiliently deformed in the direction of compression thereof in accordance with the amount of a pressing force applied to the tongue-like portion 68*c* defining the distal end portion of the male connection-detection terminal.

Figure 5:
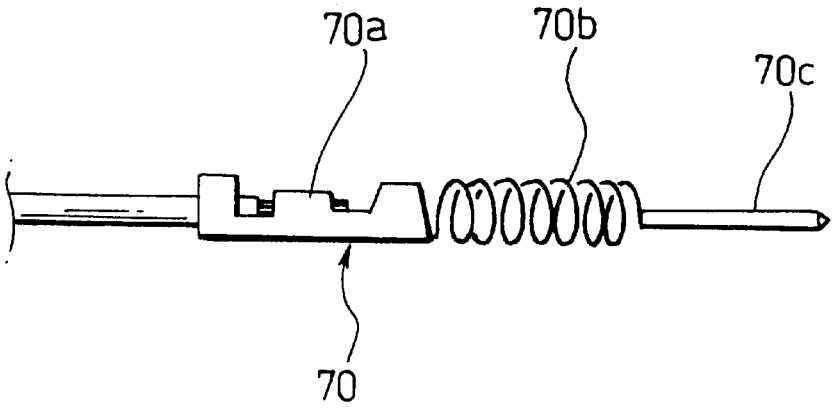
FIG. 5 is a side-elevational view of another modification of the male terminal shown in FIG. 1.
Figure 6:
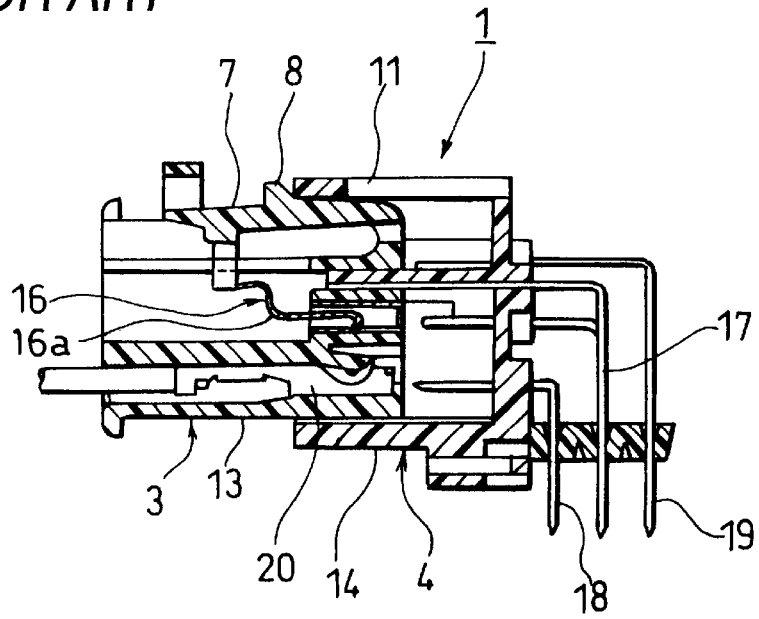
FIG. 6 PRIOR ART
FIG. 6 is a vertical cross-sectional view of a conventional half-fitting detection connector in its initially-fitted condition.
Figure 7:
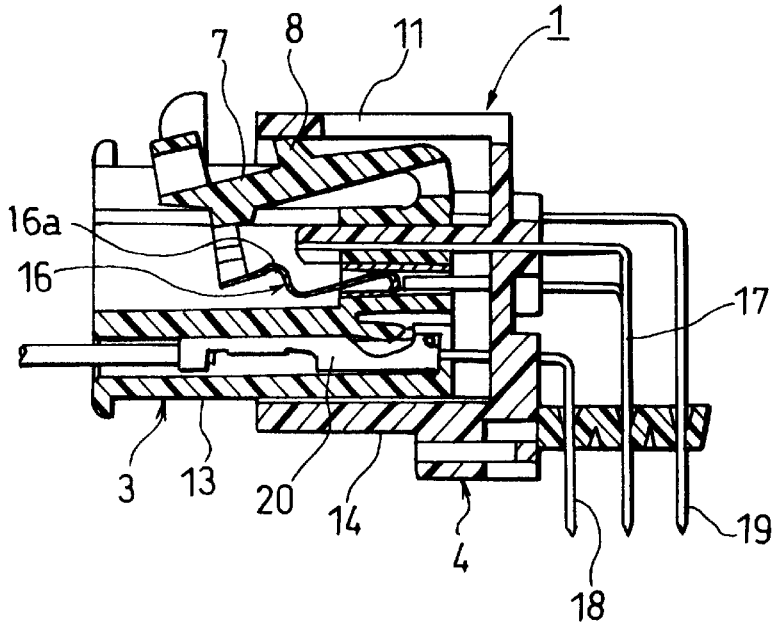
FIG. 7 PRIOR ART
FIG. 7 is a vertical cross-sectional view of the half-fitting detection connector of FIG. 6 in a half-fitted condition.
Figure 8:
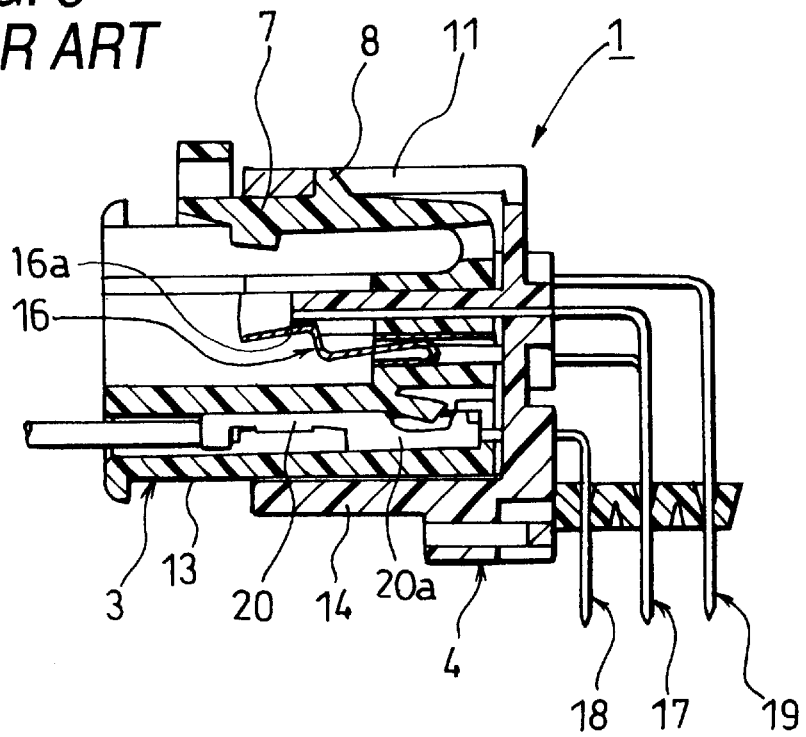
FIG. 8 PRIOR ART
FIG. 8 is a vertical cross-sectional view of the half-fitting detection connector of FIG. 6 in a completely-fitted condition.
Figure 9:
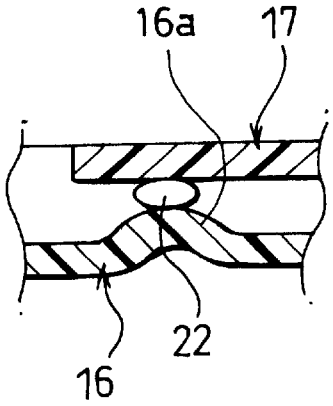
FIG. 9 PRIOR ART
FIG. 9 is an enlarged, cross-sectional view of an important portion of the half-fitting detection connector of FIG. 6, showing a problem encountered therewith.

A male connection-detection terminal 70, shown in FIG. 5, is a male connection-detection terminal to be received in the second connector, and this male connection-detection terminal of an integral construction includes a wire clamping portion 70*a* for clamping connection to the end portion of the wire, a spring portion 70*b*, and a tongue-like portion 70*c* for fitting into the female connection-detection terminal 48.

The spring portion 70*b* is in the form of a compression coil spring which can be compressively deformed along the terminal fitting direction. The spring portion 70*b* is resiliently deformed in the direction of compression thereof in accordance with the amount of a pressing force applied to the tongue-like portion 70*c* defining the distal end portion of the male connection-detection terminal.

In so far as the spring portion of the male connection-detection terminal, received in the second connector, can be compressed in the predetermined amount in a half-fitted condition of the two connectors, and can also provide the predetermined resilient force necessary for connecting the male connection-detection terminal to the female connection-detection terminal, received in the first connector, in the connector fitting operation, the spring portion, which can be compressively deformed along the terminal fitting direction, can have any suitable structure, and is not limited to the structure in the above embodiment, and can take any suitable form.

In the half-fitting detection connector of the present invention, during the connector fitting operation, the male connection-detection terminal-fitting port in the first connector is closed by the screen plate formed at the distal end of the lock arm. Therefore, the male connection-detection terminal, received in the second connector, can not enter the fitting port for the female connection-detection terminal in the first connector, so that the spring portion is compressively deformed along the terminal fitting direction, with its distal end held against the screen plate. Therefore, the female connection-detection terminal and the male connection-detection terminal are positively kept out of contact with each other.

Therefore, when the fitting operation of the half-fitting detection connector is stopped in this condition, the detection electric circuit detects a non-electrically-connected condition of the female and male connection-detection terminals, and therefore a half-fitted condition of the two connectors can be positively detected.

On the other hand, when the fitting connection between the two connectors further proceeds, so that the two connectors are completely fitted together, the retaining projection is fitted in the engagement portion, and hence ceases to be urged by the housing inner surface, so that the shutter, which has so far closed the fitting port in the first connector in the connector fitting operation, opens this fitting port.

Therefore, the distal end portion of the male connection-detection terminal, received in the second connector, projects through the fitting port in the first connector by the resilient force of the spring portion, so that the male connection-detection terminal is positively fittingly connected to the female connection-detection terminal received in the first connector. Therefore, this electrical connection between the female and male connection-detection terminals is detected, thus positively detecting the completely-fitted condition of the two connectors.

The contact of the female and male connection-detection terminals with each other is achieved by the fitting operation effected along the connector fitting direction, and therefore even if a foreign matter is deposited on the surface of the terminals, this foreign matter is removed from the surface as a result of sliding movement between the female and-male connection-detection terminals, and therefore the foreign matter will not be held between the two terminals.

Therefore, when the two connectors are completely fitted together, the female connection-detection terminal and the male connection-detection terminal will not fail to properly contact with each other because of the intrusion of a foreign matter, and the fitted condition of the two connectors can be accurately detected, and therefore the reliability of detection of a half-fitted condition can be enhanced.

What is claimed is:

1. The half-fitting detection electrical connector, comprising:

a first connector housing including a terminal receiving chamber having fitting port formed therein;

a first connection-detection terminal receivable in the first connector housing;

a second connector housing fittable to the first connector housing, the second connector housing including an engagement portion;

a second connection-detection terminal receivable in the second connector housing, and insertable into to the first connection-detection terminal, the second connection-detection terminal including a spring portion which can be compressively deformed along a fitting direction;

a lock arm formed on the first connector housing, and substantially extending in said fitting direction of the first and second connector housings, the lock arm including a retaining projection, the lock arm retaining the first and second connector housings in a fitted condition when the retaining projection is engaged with the engagement portion of the second connector housing; and a screen plate formed on a distal end of the lock arm, the screen plate closing the fitting port of the first connector housing when the retaining projection is urged by the second connector housing, and opening the fitting port to allow the first connection-detection terminal to fit to the second connection-detection terminal through the fitting port when the retaining projection is engaged with the engagement portion.

2. The half-fitting detection electrical connector according to claim 1, further comprising:

a third connection terminal receivable in the first connector housing; and a fourth connection terminal receivable in the second connector housing, and fittable to the third connection terminal, wherein a complete fitting between the third and fourth connection terminals is prevented when a fitting between the first and the second connection-detection terminals through the fitting port is obstructed by the screen plate.

3. A half-fitting detection connector according to claim 1, wherein a half-fitted condition of the first and second connector housings is detected by a condition of electrical connection between the first connection-detection terminal and the second connection-detection terminal.

4. A half-fitting detection connector according to claim 1, wherein the spring portion is formed integrally with the second connection-detection terminal.

5. A half-fitting detection connector according to claim 1, wherein the second connection-detection terminal includes a contact portion for connecting with the first connection-detection terminal, and a wire clamping portion for clamping a wire, and wherein the spring portion is formed between the contact portion and the wire clamping portion.

6. A half-fitting detection connector according to claim 1, wherein the lock arm is formed in a cantilever-like manner on an outer surface of the first connector housing to extend obliquely upwardly from the outer surface of the first connector housing in a natural condition in which no external force acts on the lock arm, so that the screen plate opens the fitting port of the first connector housing.

7. A half-fitting detection connector according to claim 6, wherein, when the first and second connector housings are in a half-fitted condition, the retaining projection of the lock arm abuts against an inner surface of the second connector housing so that the lock arm is downwardly urged toward the outer surface of the first connector housing thereby closing the fitting port with the screen plate, and the second connection-detection terminal is abutted against the screen plate, and when the first and second connector housings are in a completely-fitted condition, the retaining projection is engaged with the engagement portion formed in the inner surface of the second connector housing so that the screen plate opens the fitting port to allow the first connection-detection terminal to fit to the second connection-detection terminal through the fitting port.

8. A half-fitting detection connector according to claim 7, wherein when the first and second connector housings are in a half-fitted condition, the spring portion of the second connection-detection terminal is compressively deformed along the terminal fitting direction, and the first and second connector housings are pushed back away from each other by a resilient force of the spring portion.

9. A half-fitting detection connector according to claim 1, wherein, when the first and second connector housings are in a half-fitted condition, the retaining projection of the lock arm abuts against an inner surface of the second connector housing so that the screen plate closes the fitting port, and the second connection-detection terminal is abutted against the screen plate, and when the first and second connector housings are in a completely-fitted condition, the retaining projection is engaged with the engagement portion formed in the inner surface of the second connector housing so that the screen plate opens the fitting port to allow the first connection-detection terminal to fit to the second connection-detection terminal through the fitting port.

10. A half-fitting detection connector according to claim 9, wherein when the first and second connector housings are in a half-fitted condition, the spring portion of the second connection-detection terminal is compressively deformed along the terminal fitting direction, and the first and second connector housings are pushed back away from each other by a resilient force of the spring portion.

* * * * *